United States Patent [19]

Berneryd et al.

[11] 4,068,108

[45] Jan. 10, 1978

[54] ENCLOSED HIGH VOLTAGE CIRCUIT BREAKER

[75] Inventors: Sten Berneryd; Per-Olof Grune, both of Ludvika, Sweden

[73] Assignee: ASEA Aktiebolag, Vasteras, Sweden

[21] Appl. No.: 610,434

[22] Filed: Sept. 4, 1975

[30] Foreign Application Priority Data

Oct. 1, 1974 Sweden ..... 7412320

[51] Int. Cl.[2] ..... H01H 33/22; H01H 33/16

[52] U.S. Cl. ..... 200/148 B; 200/144 AP

[58] Field of Search ..... 200/144 AP, 148 B, 148 G, 200/148 R

[56] References Cited

U.S. PATENT DOCUMENTS

| | | | |
|---|---|---|---|
| 2,921,168 | 1/1960 | Forwald | 200/148 B |
| 3,275,778 | 9/1966 | Morioka | 200/148 B |

FOREIGN PATENT DOCUMENTS

| | | | |
|---|---|---|---|
| 1,590,217 | 4/1970 | Germany | 200/144 AP |

*Primary Examiner*—Robert S. Macon

*Attorney, Agent, or Firm*—Watson, Cole, Grindle & Watson

[57] ABSTRACT

An enclosed high voltage circuit breaker with a sulphur hexafluoride insulating and arc-extinguishing medium includes breaking gaps arranged in a high-pressure chamber which, during breaking is put into communication with a low-pressure chamber through blast valves. A closing resistor is connected in series at each end with a contact device which, upon closing, connects the resistor in parallel with the main breaking gaps before they are closed. The resistor contact device is arranged in the high-pressure chamber while the closing resistor is arranged in a separate tank substantially entirely separated from the low-pressure chamber.

5 Claims, 1 Drawing Figure

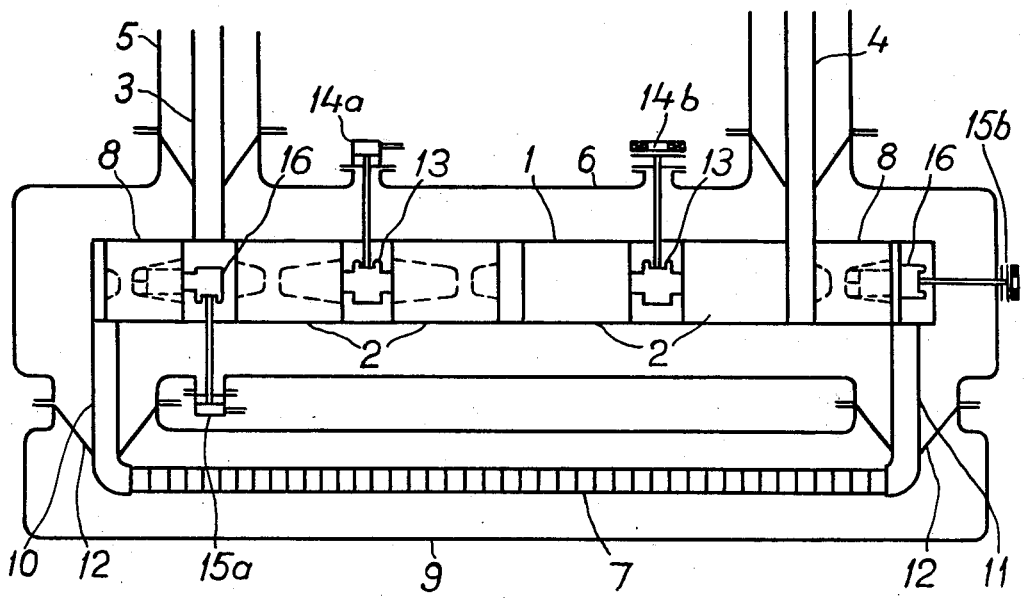
5
3
14a
14b
4
15b
8
16
13
1
6
13
8
16
2
2
10
12
15a
9
7
12
11

ENCLOSED HIGH VOLTAGE CIRCUIT BREAKER

BACKGROUND OF THE INVENTION

1. Field of the Invention

The present invention relates to an enclosed high voltage circuit breaker, particularly a circuit breaker for voltages exceeding 200 kV, containing a gaseous, fluorine-containing insulating and arc-extinguishing medium, preferably sulphur hexafluoride ($SF_6$). The circuit breaker is of the type in which the main breaking gaps are arranged in a high-pressure chamber which is adapted, during a breaking operation, to be put in communication with a low-pressure chamber through one or more blast valves.

2. The Prior Art

In circuit breakers for the high voltages prevailing in this connection, it is often necessary to use closing resistors in order to limit the switching overvoltages upon closing. These resistors must be relatively low-ohmic (of the order of magnitude of 300–500 ohms per phase), and they must be able to conduct a relatively great current for about 10 ms. Usually such resistors are built up of ceramic resistor blocks. In sulphur hexafluoride circuit breakers, however, unprotected resistor blocks of a ceramic type will be attacked by the decomposition products produced by circuit breakers during breaking. In order to prevent this, the resistors can be cast into epoxy resin, but this involves the disadvantage that they cannot be so heavily loaded.

In a known embodiment of enclosed sulphur hexafluoride circuit breakers of the two-pressure type having low-ohmic closing resistors, the resistor elements are located in a separate tank. In this way it is possible to prevent the resistor from being subjected to the harmful affect of the decomposition products generated by the breaking arcs, and, since the resistor does not have to be cast into plastic, a relatively great energy intake may be allowed. However, in this embodiment of the circuit breaker, the contact device for the resistor has been placed in the immediate vicinity of the resistor in such a way that the resistor can be exposed to harmful decomposition products which are generated through the pre-arcs occurring during closing. Since, in addition, the contact device is positioned in low-pressure sulphur hexafluoride gas, the contact distance and thus the contact path must be made relatively long, and the casing surrounding the contact device is given relatively large dimensions.

SUMMARY OF THE INVENTION

The purpose of the invention is to provide an enclosed sulphur hexafluoride circuit breaker of the two-pressure type having low-ohmic closing resistors, which is not impaired by the drawbacks mentioned above. This is achieved by locating the closing resistor in a separate chamber substantially completely separated from the low-pressure chamber, while the contact devices are arranged in the high-pressure chamber. By placing the resistor contact devices in high-pressure gas, the contact distance can be reduced, so that the dimensions of the device can be reduced and a shorter closing time can be obtained.

A particularly simple arrangement which is advantageous from the point of view of saving space is obtained by placing two resistance contact devices at either end of a high-pressure container in direct connection with the main breaking gaps. In this arrangement it is possible to a certain extent to use the same parts for the resistance contact devices as are included in the main breaking gaps, which simplifies the manufacture considerably.

BRIEF DESCRIPTION OF THE DRAWINGS

The drawing shows schematically one embodiment of the invention.

DESCRIPTION OF THE PREFERRED EMBODIMENTS

An elongated high-pressure container 1 contains, among other things, four series-connected main breaking gaps 2 for breaking and closing the connection between the electric conductors 3 and 4, which are arranged centrally inside a tubular grounded metal casing 5. The high-pressure container 1 is partially surrounded by a low-pressure container 6.

The containers 1 and 6 and the casing 5 are filled with sulphur hexafluoride. The pressure may be, for example, 1.7 MPa in the high-pressure container 1 and 0.4 MPa in the low-pressure container 6 and the casing 5.

In order to limit the switching overvoltages upon closing, there is arranged, in parallel with the main breaking gaps 2, a closing resistor 7 which is switched in by means of two contact devices 8 connected in series with the resistor and placed at either end of the high-pressure container 1. The closing resistor 7 is arranged in a separate tank 9, which is attached to the low-pressure tank 6. The electric conductors 10 and 11, which connect the resistor 7 with the contact devices 8, are supported by two conical supporting insulators 12 forming partitions between the low-pressure container 6 and the resistor tank 9. The partition walls prevent the corrosive decomposition products generated by the switching arcs from penetrating into the resistor tank.

Upon breaking, the blast valves 13 of the main breaking gaps are opened, so that gas flows from the high-pressure container 1 into the low-pressure container 6. The arcs formed between the breaking contacts, which arcs are located in the gas stream, will then be rapidly deionized and extinguished. A compressor arranged between the low-pressure and the high-pressure systems will thereafter restore the original pressure difference. The operating devices for the blast valves can be constructed in several ways, for example as indicated in the drawing, where a pneumatic operating device **14*a* (with an operating piston movable in a cylinder) as well as an electrodynamic operating device 14*b* (with an operating coil and a "kick-plate") are shown. The same is true for the operating devices 15*a* and 15*b* for the quick-operating valves 16 of the resistance contact devices 8. For the last-mentioned operating devices, the drawing also shows two different locations, namely, on the one hand with the valve operating rod directed in the axial direction (operating device 15*b*) of the high-pressure container, and on the other with the operating rod directed perpendicular to that container (operating device 15*a***). In practice, of course, operating devices of the same construction are used in any particular circuit breaker, and the operating devices are suitably located in the same way.

During closing, the resistance contact devices 8 are first closed and connect the closing resistor 7 between the electric conductors 3 and 4. Thereafter, the main breaking gaps 2 are closed, the resistance contact devices 8 thereafter finally being reopened.

We claim:

1. An enclosed high voltage circuit breaker of the two-pressure type having means for controlling breaking and closing operations, comprising:

a high pressure chamber and a low pressure chamber;

said high pressure chamber containing a gaseous insulating and arc-extinguishing medium comprising a fluorine containing compound, and including main breaking gaps mounted therein;

at least one blast valve for interconnecting said high pressure chamber with said low pressure chamber during breaking operation;

a tank isolated from said low pressure chamber and said high pressure chamber, and including a closing resistor mounted therein; and said high pressure chamber further including contact means for connecting said closing resistor in parallel with said main breaking gaps during closing operation.

2. A circuit breaker as in claim 1 wherein said gas is sulphur hexafluoride.

3. A circuit breaker as in claim 1 wherein said low pressure chamber partially surrounds said high pressure chamber and said tank surrounds the remainder of said high pressure chamber; and further comprising means for isolating said tank and low pressure chamber from each other.

4. A circuit breaker as in claim 3 wherein said contact means comprises a contact device mounted at each end of said high pressure chamber and further comprising means for respectively connecting each of said contact devices to a respective terminal of said closing resistor.

5. A circuit breaker as in claim 1 further comprising means for operating said contact means and said main breaking gaps during closing operation whereby said contact means are first closed, said main breaking gaps are closed, and said contact means are reopened, sequentially.

* * * * *